US007828116B2

(12) United States Patent
Vetesnik

(10) Patent No.: US 7,828,116 B2
(45) Date of Patent: Nov. 9, 2010

(54) MOBILE MOUNT FOR ATTACHMENT OF A FALL ARREST SYSTEM

(76) Inventor: Jan Vetesnik, 6 Wayfarer's Haven, Winnipeg, Manitoba (CA) R3X 1Z2

( * ) Notice: Subject to any disclaimer, the term of this patent is extended or adjusted under 35 U.S.C. 154(b) by 941 days.

(21) Appl. No.: 11/509,084

(22) Filed: Aug. 24, 2006

(65) Prior Publication Data

US 2007/0205047 A1 Sep. 6, 2007

Related U.S. Application Data

(63) Continuation-in-part of application No. 11/283,413, filed on Nov. 21, 2005, now Pat. No. 7,363,875, and a continuation-in-part of application No. 10/841,838, filed on May 10, 2004, now Pat. No. 7,740,106.

(51) Int. Cl.
*A62B 35/00* (2006.01)

(52) U.S. Cl. ..... 182/18; 182/3; 182/8; 182/63.1; 182/115; 182/116

(58) Field of Classification Search ..... 182/3, 182/4, 8, 18, 63.1, 115, 116, 127; 116/200, 116/212, DIG. 34; 212/276
See application file for complete search history.

(56) References Cited

U.S. PATENT DOCUMENTS

| | | | | |
|---|---|---|---|---|
| 476,607 | A | 6/1892 | Caldwell | |
| 670,548 | A | 3/1901 | Sliger | |
| 1,253,924 | A | 1/1918 | Barnett | |
| 1,899,162 | A | 2/1933 | Lackner | |
| 2,054,281 | A | 9/1936 | Chauncey | |
| 2,565,777 | A | 8/1951 | Moon | |
| 2,581,176 | A | 1/1952 | Dempsey | |
| 2,614,744 | A * | 10/1952 | Hedglon | 182/106 |
| 2,656,088 | A * | 10/1953 | White | 182/106 |
| 2,693,386 | A | 11/1954 | Renfroe | |
| 2,871,915 | A | 2/1959 | Hogan | |
| 2,916,034 | A | 12/1959 | Detwiler | |
| 2,957,542 | A * | 10/1960 | Rizzuto | 182/129 |
| 2,961,060 | A | 11/1960 | Taylor | |
| 3,022,855 | A | 2/1962 | Lewis | |
| 3,077,178 | A | 2/1963 | Gordon | |
| 3,151,693 | A | 10/1964 | Chapman | |
| 3,232,377 | A | 2/1966 | Smith | |

(Continued)

OTHER PUBLICATIONS

Regulations for Fall Protection Systems Criteria and Practices—1926.502. US Department of Labor, (OSHA) pp. 1-18 (Printed Nov. 13, 2006, as last amended Jan. 26, 1995).

*Primary Examiner*—Katherine W Mitchell
*Assistant Examiner*—Colleen M Quinn
(74) *Attorney, Agent, or Firm*—IPLM Group, P.A.

(57) ABSTRACT

A mobile mount for attachment of a fall arrest system is provided for example for aircraft and includes a base carried on ground wheels and a support which is adjustable in height upstanding from the base and an arm cantilevered over the base. At least one receptacle is mounted on the arm of the support at a position located over the base for attachment to a personal fall arrest system including a harness for one or more persons, with the receptacle, base and support being designed and arranged to receive a loading from the personal fall arrest system sufficient to accommodate a fall of the person from the elevated structure.

14 Claims, 7 Drawing Sheets

U.S. PATENT DOCUMENTS 3,325,810 A 6/1967 Johnson et al.
3,378,101 A 4/1968 Zeitler
3,451,504 A 6/1969 Logan
3,490,558 A * 1/1970 Foley ..... 182/103
3,598,200 A * 8/1971 Thompson ..... 182/8
3,664,458 A 5/1972 Sterns et al
3,752,261 A 8/1973 Bushnell, Jr.
3,757,967 A 9/1973 Colbridge
3,760,963 A 9/1973 Welch
3,853,546 A 12/1974 Werner et al.
3,908,791 A * 9/1975 Kleine et al. ..... 182/8
3,934,918 A 1/1976 Kress et al.
3,997,024 A 12/1976 Fredricks et al.
4,004,652 A 1/1977 Laboy-Alvarado
4,015,686 A 4/1977 Bushnell, Jr.
4,090,399 A 5/1978 Babcock
RE30,072 E 8/1979 Kleine et al.
4,258,825 A 3/1981 Collins
4,407,392 A 10/1983 Lazzari
4,427,093 A 1/1984 Wehmeyer et al.
4,458,785 A 7/1984 Bushnell, Jr.
4,529,063 A 7/1985 Kishi
4,618,029 A 10/1986 Lowry
4,660,679 A * 4/1987 Ostrobrod ..... 182/18
4,705,140 A 11/1987 Dudley et al.
4,709,782 A 12/1987 Lipinski
4,709,783 A * 12/1987 Tomioka et al. ..... 182/8
4,798,262 A * 1/1989 Margolies ..... 182/106
4,875,547 A 10/1989 Hanthorn
4,987,976 A 1/1991 Daugherty
5,036,949 A 8/1991 Crocker et al.
5,103,755 A 4/1992 Garrett
5,105,913 A 4/1992 Neubauer et al.
5,111,907 A 5/1992 Kishi
5,143,170 A 9/1992 Hunt et al.
5,156,233 A 10/1992 Olsen et al.
5,199,688 A 4/1993 Engel
5,295,555 A 3/1994 Strange
5,295,557 A 3/1994 Taylor
5,350,037 A 9/1994 Ghahremani
5,411,111 A 5/1995 Greve
5,474,151 A 12/1995 Yonahara
5,492,067 A 2/1996 Anderson
5,503,358 A 4/1996 Lapp
5,522,472 A 6/1996 Shuman et al.
5,555,953 A 9/1996 Henderson
5,564,523 A 10/1996 Howard
5,575,220 A 11/1996 Van Soest et al.
5,622,237 A * 4/1997 Moldow ..... 182/37
6,148,580 A 11/2000 Weir
6,170,802 B1 1/2001 Stovall
6,269,904 B1 8/2001 Morhaus
6,408,587 B2 6/2002 Cronin et al.
6,467,576 B2 * 10/2002 Figura et al. ..... 182/63.1
6,571,398 B2 6/2003 Stahl et al.
6,575,100 B2 6/2003 Faucher et al.
6,823,964 B2 11/2004 Goode
6,830,423 B1 12/2004 Williams et al.
7,032,710 B2 * 4/2006 Anderson et al. ..... 182/16
7,255,198 B1 * 8/2007 Lo ..... 182/172
7,363,875 B2 4/2008 Vetesnik
2005/0247517 A1 11/2005 Vetesnik
2005/0274572 A1 12/2005 Stelzer
2009/0152045 A1 6/2009 Vetesnik

* cited by examiner

MOBILE MOUNT FOR ATTACHMENT OF A FALL ARREST SYSTEM

This application is a continuation-in-part of application Ser. No. 10/841,838 filed May 10, 2004 now U.S. Pat. No. 7,740,106 and is a continuation-in-part of application Ser. No. 11/283,413 filed Nov. 21, 2005 now U.S. Pat. No. 7,363,875.

The present invention relates a mobile mount for attachment of a fall arrest system.

BACKGROUND OF THE INVENTION

Fall protection of operators working in a situation where a fall can take place over a sufficient distance to cause injury or death is becoming generally required in most industries. Many arrangements are provided for mounting an anchor post on a structure adjacent the worker so that a personal fall arrest system can be attached to the anchor.

Such personal fall arrests systems include a harness together with a cable system for attachment to the harness and to a suitable anchor where the cable system can be paid out to allow the worker to move to a required location but the cable system arrests any fall within a short distance. Such devices are well known and commercially available and many different designs have been proposed.

In most cases the structure itself provides or has attached a suitable anchoring post so that the relatively high loading necessary can be readily provided by a simple post rigidly attached to the structure.

In the interior buildings, such anchors can be mounted on a rail which allows the anchor to slide longitudinally along a track attached to the rail.

However some structures are unsuitable for attachment of an anchor post or have been designed without the possibility of attachment of an anchor post so that operators in this environment are often unprotected against fall. In a particular area where this is problematic is in that related to aircraft where aircraft design does not lead to the suitability of attachment of mounting posts. Up until now, therefore, operators working in this environment have remained unprotected with the potential of serious injury or death.

SUMMARY OF THE INVENTION

According to a first aspect of the invention there is provided an apparatus comprising:

a base carried on ground wheels for movement over a ground surface to an elevated structure on which one or more persons is intended to work;

a ladder upstanding from the base to an elevated position above the base;

the upstanding ladder being adjustable in height from the base;

the upstanding ladder including two side rails and transverse rungs such that said one of more persons can climb the ladder to the elevated structure;

at least one of the side rails of the ladder having mounted thereon a tubular receptacle;

a post member mounted in the tubular receptacle and shaped and arranged so as to extend upwardly from the receptacle and forwardly beyond the end of the upper part of the ladder;

and at least one support member at an end of the post member remote from the tubular receptacle for attachment to and loading from a personal fall arrest system for attachment to said one or more persons.

Preferably each of the side rails includes a respective tubular receptacle and a respective post member and wherein there two support member each carried on a respective one of the post members and each for receiving the personal fall arrest system of a respective one of two separate persons.

Preferably the support members are arranged and mounted on the ladder so as to allow side to side movement of the support member relative to the base.

Preferably the base includes a hitch by which the base can be moved to the elevated structure by a towing vehicle.

Preferably there is provided a platform at a top of the ladder extending from the top of the ladder outwardly over the base.

Preferably the post member and the support member are arranged such that the support member is cantilevered generally over a mid line of the base.

Preferably the or each support member comprises a loop for receiving a hook of the personal fall arrest system.

Preferably the post member is inclined forwardly of an upper end of the side rail to cantilever the support member in front of the ladder.

Preferably there is provided a platform between rails at the top of the ladder for the person to step onto the elevated structure.

Preferably the tubular receptacle allows adjustment of the post member relative to the side rail of the ladder.

Preferably the tubular receptacle allows height adjustment of the post member relative to the side rail of the ladder.

Preferably the post member is inclined upwardly, forwardly from the respective rail and outwardly to one side of the respective side rail away from the other of the side rails.

Preferably the tubular receptacle is vertical and the post member includes a vertical post portion and an arm extending from the post portion to the support member.

Preferably there is provided a deformable link between the post portion and the arm, the deformable link comprising a longitudinal member having opposite ends spaced apart by a first distance, said deformable link extending between the first and second connection points, thereby supporting the arm on the post portion; the deformable link being adapted to bend if the load exceeds the load limit of the apparatus thereby visually indicating overloading of the apparatus; and the arm being arranged to move during bending of the deformable link such that the distance between the ends of the deformable link is decreased.

Preferably the load is supported on the arm at a loading point distally spaced from the post.

Preferably the deformable link further comprises a plurality of slots spaced along the deformable link between the opposite ends thereof, said slots extending into said deformable link from a first side thereof.

Preferably the deformable link comprises a U-shaped cross section defining a central portion separating two spaced apart side portions, said side portions extending from the central portion toward the first side of the deformable link such that the plurality of slots are spaced along and extend into each of said side portions.

Preferably the slots in the side portions of the longitudinal member do not extend to the central section thereof.

BRIEF DESCRIPTION OF THE DRAWINGS

On embodiment of the invention will now be described in conjunction with the accompanying drawings in which.

DETAILED DESCRIPTION

Figure 1:
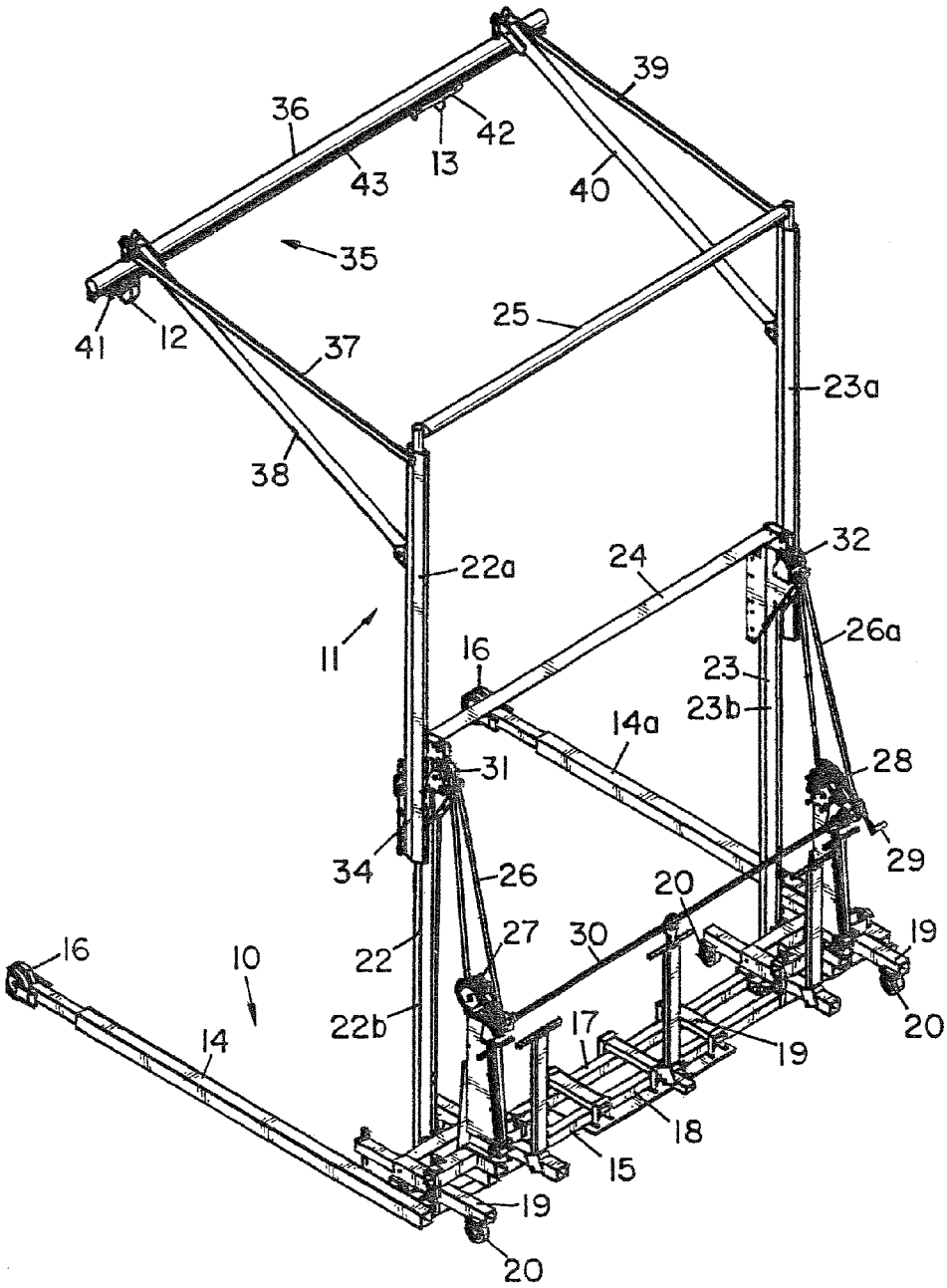
FIG. 1 is an isometric view of a first embodiment which is the subject of application Ser. No. 10/841,838 filed May 10, 2004 which is now issued as U.S. Patent INSERT.

In FIG. 1 is shown a first embodiment according to the present invention which includes a base 10 and a support 11 for supporting anchors or receptacles 12 and 13 at a raised position above the base.

The base comprises a pair of side rails 14 and 15 extending forwarding from a rear frame structure 15. At the outer end of each side rail is provided a ground engaging wheel 16 for rolling over the ground supporting the base.

The frame 15 comprises a pair of rails 17 and 18 which are parallel and generally at right angles to the side rails 14 and 14A. The rails 17 and 18 are parallel and interconnected by a number of cross members 19 which hold the rails parallel. The rails 14 and 14A are attached to respective ends of the rails 17 and 18 so as to form a rigid structure. Some of the cross members 19 extend outwardly beyond the rails 17 and 18 and provide a support for a ground wheel 20 which cooperates with a ground wheel 16 in supporting the base for movement across the ground. The number of ground wheels and arrangement of ground wheels depends upon the weight to be supported and the type of ground wheel to be used. The base provides a relatively wide area for support over the ground to prevent toppling of the structure when load is applied.

At opposite ends of the frame 15 is provided a pair of upstanding posts 22 and 23 which form a part of the support 11. The upstanding posts are formed in two sections including upper portions 22A and 23A which are slidable vertically relative to the lower portions 22B and 23B. Suitable mounting using bearings can be provided between the portions to allow the vertical sliding movement required to elevate the upper section relative to the lower section. A cross member 24 connects the upper end of the lower portions 22B and 23B to retain the structure rigid. A similar cross member 25 is provided across the top of the upper portions 22A and 23A to maintain the upper section rigid. The upper section is raised relative to the lower section by chains 26 and 27 carried on lower pulleys 27 and 28 respectively operated by manually rotatable handle 29 attached to a shaft 30. The shaft 30 extends between the two pulleys 27 and 28 so the rotation of the handle 29 pulls the chains 26 and 27 over an upper pulley 31, 32 respectively at the top of the respective posts portions 22B and 23B so as to pull on the lower end of the upper portions 22A and 23A pulling them upwardly along the slide mounting indicated at 34.

Thus the upright portion of the support 11 defined by the posts and the cross members can be raised and lowered to a required height. At the top of the upper portion of the posts is provided a cantilever arm section generally indicated at 35 forming part of the support 11. The cantilever arm structure comprises a rail 36 parallel to the cross beams 25 and 24 and cantilevered outwardly therefrom on support rails 37, 38, 39 and 40. The rails 38 and 40 form a brace at an angle to the rails 37 and 39 thus maintaining the rail 36 at a position approximately midway across the base from the frame 15 towards the wheels 16.

The rail 36 is formed by a structural tube together with a transport track attached to the underside of the structural tube so the track carries a pair of trolleys 41 and 42 which can slide along the track 43 independently of one another. Each trolley carries a respective one of the anchors 12, 13.

Thus the apparatus shown in FIG. 1 can be wheeled to a required location at an elevated structure with the rail 36 supported at a position above the elevated structure by any necessary adjustment of the height of the support. The location of the rail 36 over the elevated structure can be obtained by moving the base on the wheels to the required position relative to the elevated structure. The arrangement as shown is particularly suitable for location over the wing of an aircraft with the rail 36 at a position approximately head height above the operator standing on the wing. Thus the base is located under the wing with the rail 36 above the wing.

The structure is designed and arranged to provide sufficient loading so that the anchors can receive the full force obtained by an operator falling from the elevated structure.

In practice it has been determined that the necessary loading which the anchor must accommodate is of the order of 1800 lbs. for a single operator and either 2000 lbs. or 3000 lbs. for two operators depending upon the jurisdiction where the standards are in force. Thus the anchor is not merely an anchor location but must provide sufficient strength so that the fall of a heavy operator potentially carrying heavy equipment and the impact of that fall on the personal fall arrest system can be applied to the anchor and through the anchor to the ground without damaging the structure or allowing the operator to fall beyond the intended position arrested by the fall arrest system.

Figure 2:
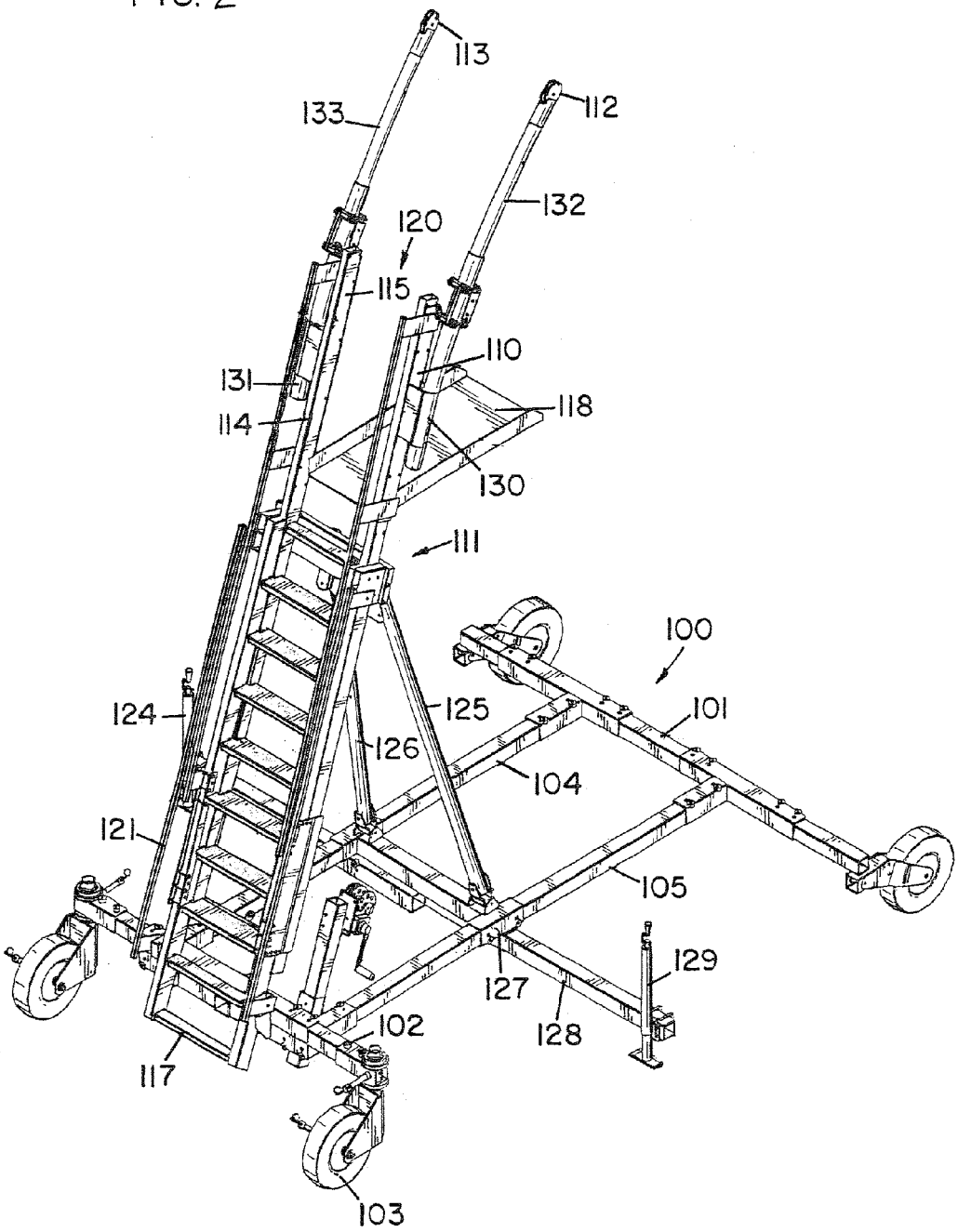
FIG. 2 is an isometric view of a first embodiment according to the present invention.

Turning now to FIG. 2, an alternative embodiment is shown including a base 100 and a support 111 for anchors 112 and 113. In this embodiment the base 100 is formed by cross beams 101 and 102 carrying ground wheels 103 together with longitudinal rails 104 and 105. The wheels are suitable castor wheels or may alternatively be driven wheels for moving the base by powered operation.

In this embodiment the support 111 is in the form of a ladder structure 114 with side rails 115 and 116 together with transverse rungs 117 and an upper platform 118. The ladder structure is again formed in two pieces with an upper part 120 which can be raised relative to a lower part 121 by actuation of a manually operable chain lifting system 124. Thus the upper parts of the rails of the ladder can slide upwardly to raise the platform 118 and the anchors 112 and 113 to a required height above an elevated structure to operated on. The lower part of the ladder is rigidly attached to the cross beam 102 and is supported by braces 125 and 126 extending downwardly to the longitudinal rails 104 and 105. The lower end of the braces is attached to slide members 127 which can move longitudinally along the respective rails 104, 105 and carry a cross beam 128 which has stabilizing legs 129 at each end. The stabilizing legs can be moved down into engagement with the ground so as to transfer some loading from the base from the wheels to the legs to maintain the base at a required location.

At the upper end of the rails 115 and 116 of the ladder is provided tubular receptacles 130, 131 for a pair of davits each defined by a curved post 132 and 133 respectively which extends upwardly from the receptacle and forwardly beyond the end of the upper part of the ladder to the upper anchor 112, 113 respectively. Thus the anchors are cantilevered forwardly beyond the end of the ladder by the curvature of the posts 132 and 133. Thus again the anchors 112 and 113 are located approximately over the midline of the base and a cantilevered structure with the base located underneath the structure. Again this arrangement is particularly suitable for the wing of an aircraft where the base can be moved to a position beneath the wing with the platform moved up to the end of the wing and the anchors 112 and 113 located over the wing for the operator to transfer from the platform onto the wing for operations on the aircraft.

Figure 3:
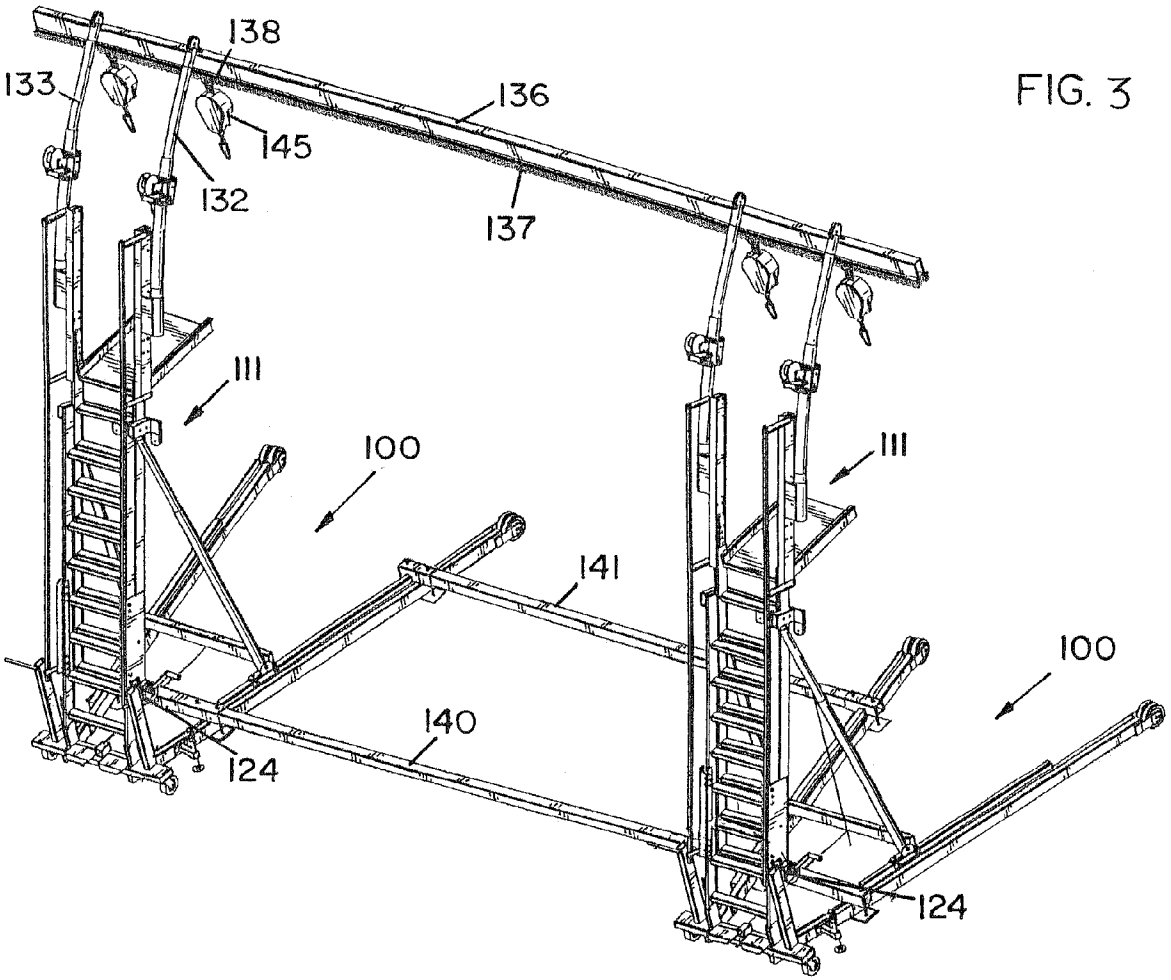
FIG. 3 is an isometric view of a modified version of the embodiment of FIG. 2 incorporating two of the components of FIG. 2 connected together.

In FIG. 3 is shown an alternative arrangement which utilizes basically the structure of FIG. 2 arranged in a pair of such structures connected together by cross members 140 and 141. Thus each base 100 and each support 111 is provided at a position spaced transversely of the base frames and connected together at spaced positions by the rails 140 and 141. At the top of the curved posts 132 and 133 is provided a transverse rail 136 similar to the rail 36 which carries a track 137 and trolleys 138. Each trolley is attached to a personal safety arrest system generally indicated at 145. Thus the basic system shown in FIG. 3 can be modified to provide an elongated structure defining an elongated protection system along the full extent of the rail 136, which may be up to 30 feet in length, so that a number of operators can be properly protected by personal fall arrest systems slidable along the rail 136 in its track 137. The rail 136 can be removed from the posts 132 and 133 and the base 100 can be separated to provide two separate elements which can be used independently. The base structure in FIG. 3 is slightly different in construction from that shown in FIG. 2 in that the side rails extend at an angle outwardly and the wheels are attached to the ends of the side rails rather than to the ends of the cross rail 101 as shown in FIG. 3. It will be appreciated that different forms of the base structure be designed with the intention that the structure merely provides sufficient ground engagement area to accommodate any side loads which occur as an operator falls to prevent the system from toppling and to maintain the rail 136 at its elevated position despite any direction of fall of one or more operators from the elevated structure.

The structure shown in FIG. 1 can also be extended by providing additional posts and increasing the length of the rails 24, 25 and 36. Thus for example the basic rail 36 may be of the order of 20 ft. which should be increased to 30 ft. by providing an additional post to provide three such posts in a row.

Figure 4:
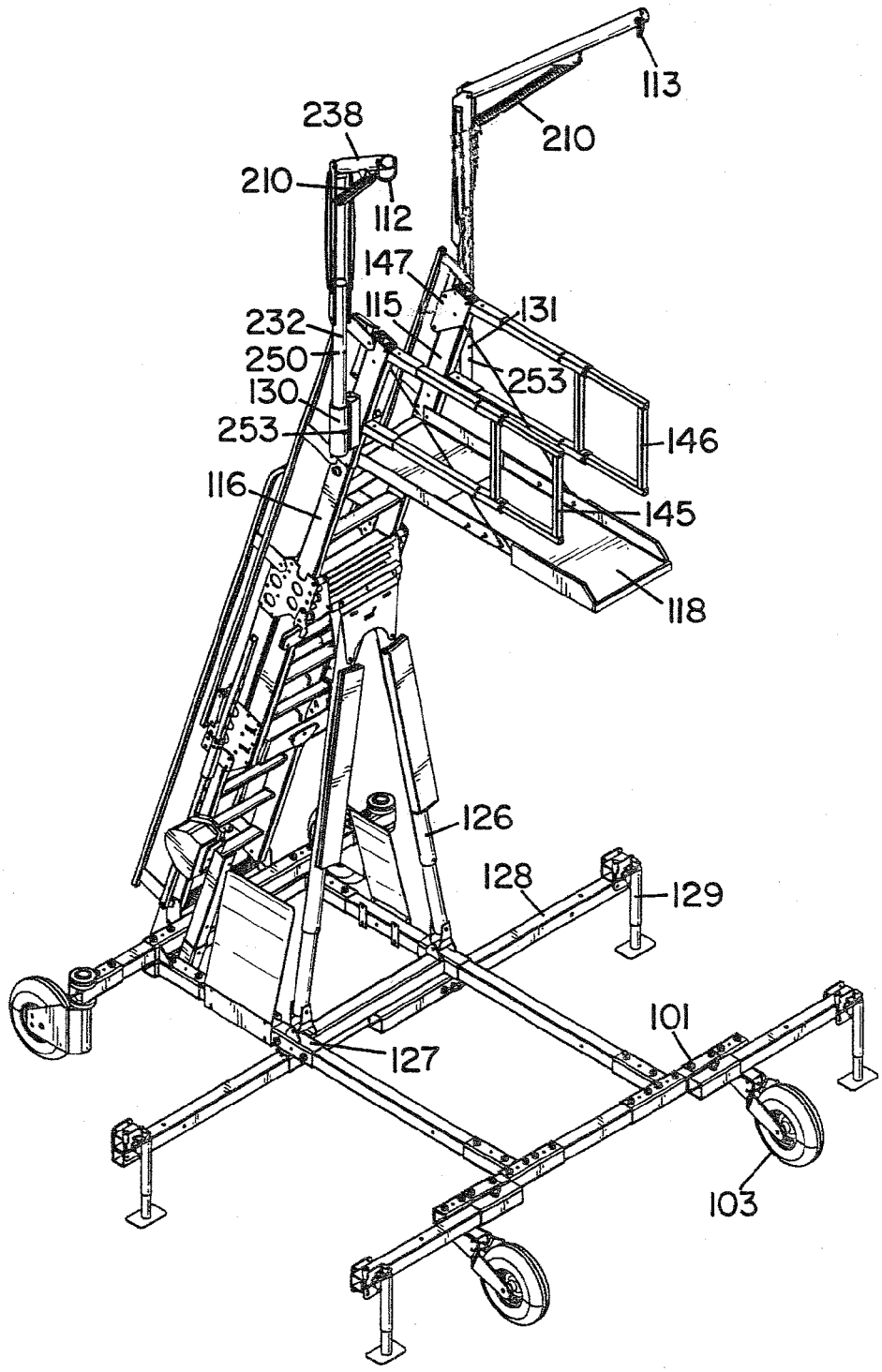
FIG. 4 is an isometric view of a second embodiment according to the present invention which is similar to that of FIG. 2 but includes a number of modifications.
Figure 5:
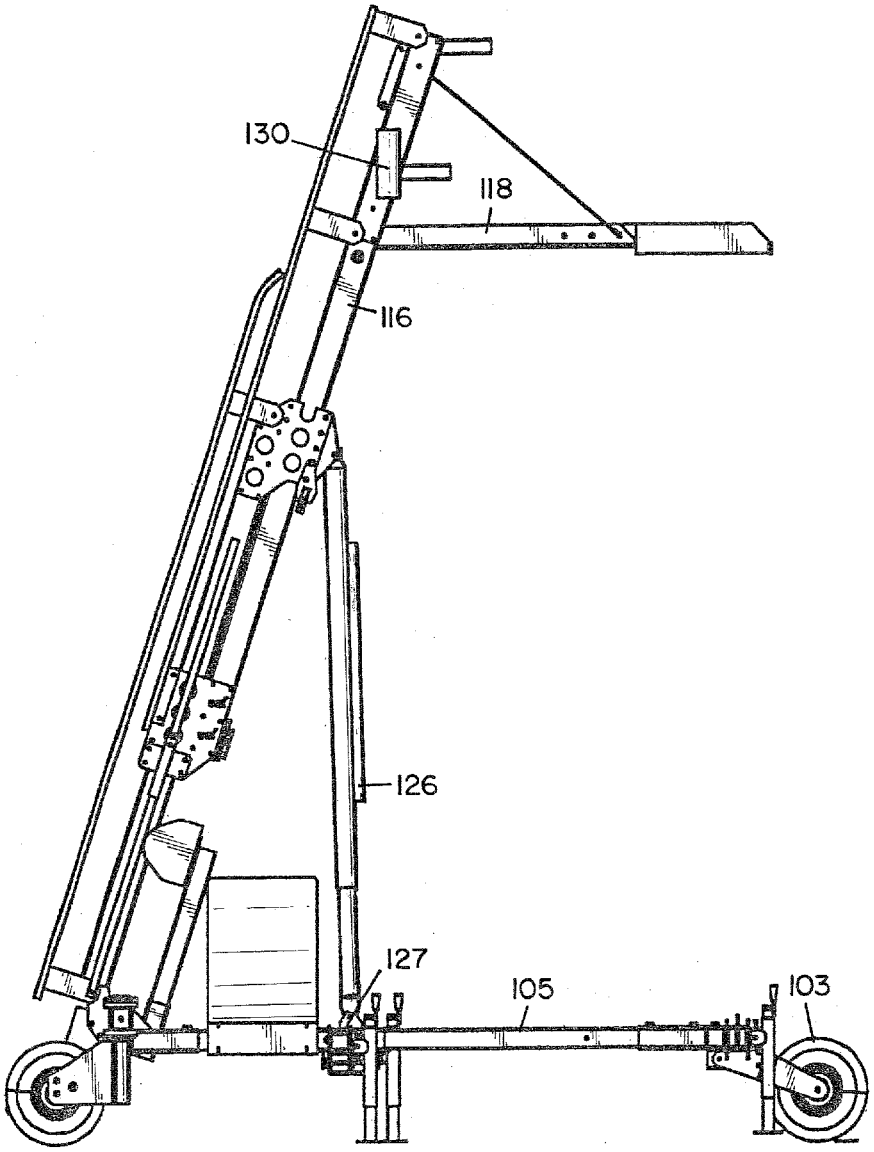
FIG. 5 is a side elevational view of the embodiment of FIG. 4.

FIGS. 4 and 5 show isometric and side views respectively of the embodiment of FIG. 2. It will be noted that additional side panels 145 and 146 are added in FIG. 4 on the sides of the platform 118 to inhibit falling by the user. These can be attached to suitable mounting brackets 147 on the rails 115 and 116. The side rails and the platform can be extended by sliding an outer part inwardly and outwardly relative to an inner part.

Figure 6:
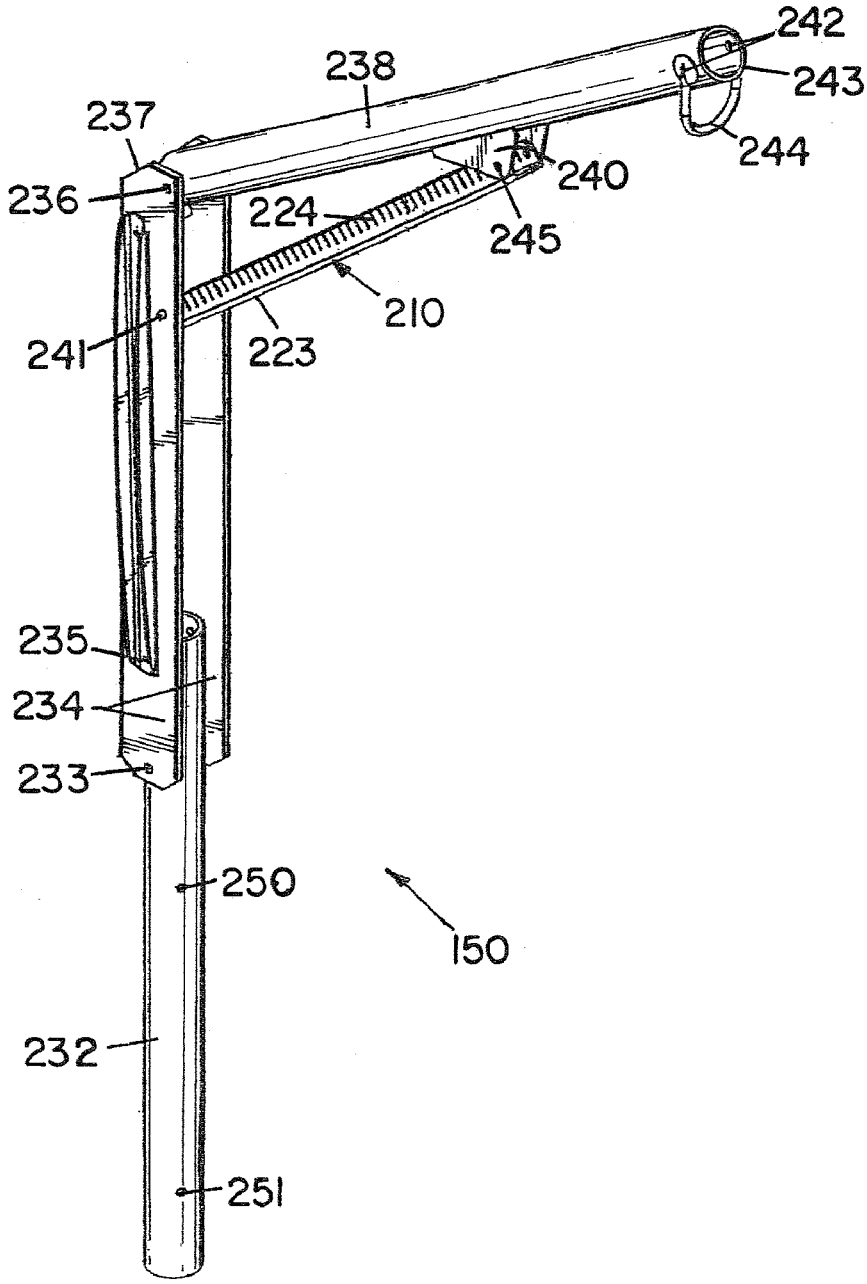
FIG. 6 is an isometric view of a davit used in the embodiment of FIGS. 4 and 5.

The davits of FIG. 2 which include the curved post construction are replaced in FIG. 4 by an alternative form of the davit which is shown in FIG. 6. This includes an upright post 232 and an arm 238 supported by a deformable link 210.

FIG. 6 illustrates the davit assembly 150 featuring the first embodiment of a deformable link or overload indicator 210 as described hereinafter. In this particular assembly 150, the first member consists of a vertically arranged post 232 having a pair of side plates 234 attached at points 233 and 235 by means of bolting arrangements including bolts, washers and nuts. The plates 234 extend vertically upward from the post 232 to an upper end 237. The second member in the davit assembly 150 is a longitudinal support member or arm 238 extending upward and out to one side of the post 232 and side plates 234. The support member 238 is connected to the side plates 234 at an attachment point 236 near the upper end 237 of the plates by a bolting arrangement that will resist moments about that point. The support member 238 is arranged to support a load (not shown) at a loading point 242 near a distal end 243 opposite the plates 234 and post 232 by means of a U-bracket 244 which forms the support 112 or 113.

The overload indicator 210 is mounted between the support member 238 and the side plates 234 such that the side 223 from which slots 224 extend into the indicator 210, as described in more detail hereinafter, face upward toward the support member 238 and side plates 34. The overload indicator 210 is attached to the side plates 234 at a first connection point 241 by bolting arrangements including appropriate spacers. The indicator 210 is attached to the support member 238 at a second connection point 245 on brackets 240 provided on the support member 238, again by bolting arrangements.

The post 232 is mounted in the tubular support or sleeve 130 as a sliding fit such that the post can be rotated relative to the sleeve and can be adjusted in height relative to the sleeve 130.

The post includes holes 251 and 252 which cooperate with selected holes in the sleeve so as to set a selected height and orientation of the post in the sleeve. When the post is at a raised height the top of the post is approximately at a height of 6 feet from the platform and the support arm 238 extends upwardly at an inclined angle to the horizontal from the top of the post to a height of the order of 8 feet which is above the head of the user. In this way the safety fall arrest system is located above head height. However it will be noted that the arms extend upwardly and outwardly away from the platform 118 so that the arms do not extend over the platform but are at all times maintained to one side of the platform. The arms thus are arranged at an angle to one another inclined outwardly away from one another. This directs the arm along the elevated structure to which the platform meets away from the platform allowing the user to walk along the elevated structure away from the platform when exiting from the platform. Also the height adjustment of the post in the sleeve allows the post and the arm to be lowered to a reduced height in which the outer end of the arm is below head height. In this way the platform can be brought up to the underside of an elevated structure and the operator can reach up to the elevated structure from the platform without the danger of the arm impacting on the structure and casing damage thereto. The post can of course also be fully removed from the sleeve as shown in FIG. 5 allowing the ladder and platform to be used without the davit.

The supports 112 and 113 are directly attached to the end of the support arms 238 and there is no safety rail which extends horizontally from the end of the support arm above and over the platform.

Figure 7:
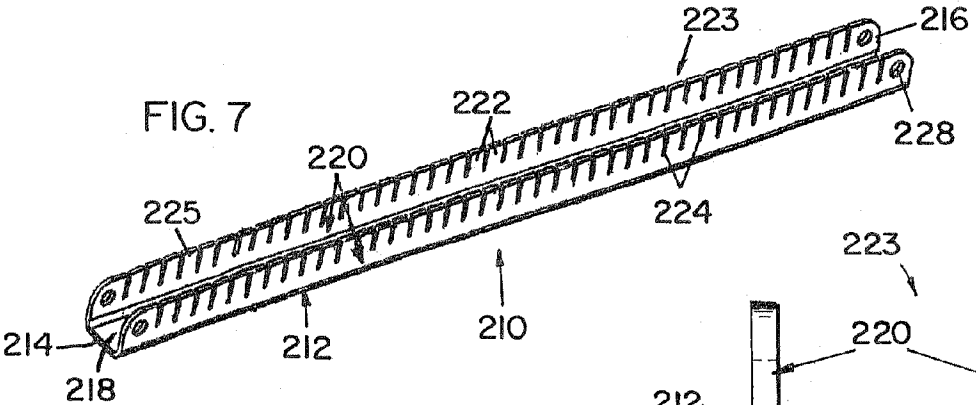
FIG. 7 is an isometric view of the deformable link used in the davit of FIG. 6 of the embodiment of FIGS. 4 and 5.
Figure 8:
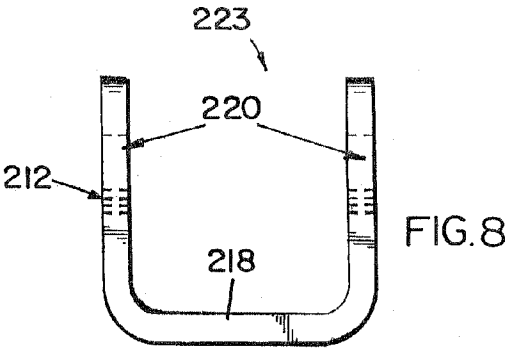
FIG. 8 is a cross-sectional view of the deformable link of FIG. 7.

The deformable link 210 is shown in FIG. 7. The overload indicator 210 is made of a longitudinal member 212 having a U-shaped cross section as shown in FIG. 8. The U-shaped member 212 has a central portion 218 extending perpendicularly between parallel side portions 220. Between opposite ends 214 and 216, the longitudinal member 212 has a series of slots 224 extending from a side 223 opposite the central portion 18 toward the central portion 218 in each side portion 220. These slots 224 define teeth 222, each of which is positioned between two adjacent slots 224. At each of the ends 214 and 216, there is provided a pair of holes for mounting the deformable link on an appropriate load supporting apparatus. A hole 228 is provided through each side portion 220 at each of the ends 214 and 216 for use as a connection point by means of which the deformable link 210 can be installed for use in a load supporting apparatus.

The absence of material in the side portions 220 created by the slots 224 weakens the ability of these side portions 220 to resist compression loading along a longitudinal axis of the deformable link 210. The central portion 218 however, remains intact as a solid piece having and thus has a greater strength than the side portions 220. As a result, longitudinal loading of the deformable link 210 will tend to cause the longitudinal member 212 to bend, or bow, forming a concave curvature along the side 223 as the slots 224 close and the teeth 222 move together such that the deformable link 210 takes on a curved form. With adjacent teeth 222 coming into contact, the strength of the deformable link 210 is increased as the slots 224 close up. While weakened by the presence of the slots 224, it should be noted that the longitudinal member 212 will not bend under any longitudinal loading, but rather will only do so under excessive loading in which a predetermined limit is exceeded. The slot dimensions, slot spacing and longitudinal member material are all chosen so as to provide the deformable link 210 with the appropriate bending characteristics for use in a specific load supporting apparatus having a particular loading limit. The deformable link 210 therefore will only begin to bend when the apparatus has been loaded beyond the upper limit of its recommended load range, thereby indicating to a user that the apparatus has been overloaded.

Figure 9:
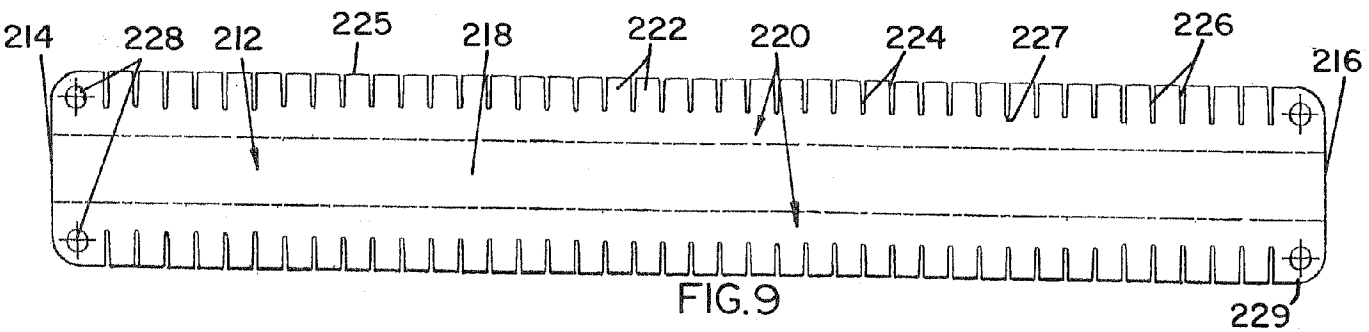
FIG. 9 is a plan view of a metal panel to be bent to form the deformable link of FIG. 7.

FIG. 9 shows the deformable link at an intermediate stage of its manufacture. Using dies, a 3/16" steel plate is formed having the two dimensional shape shown in the figure. In order to obtain the U-shaped cross section of the final product, as shown in FIG. 8, the side portions 220 are bent 90 degrees along the broken lines shown in FIG. 9. A series of six slots nearest each of the ends 214 and 216 of each side portion 220 is longer than the slots 224 between the two series of each side portion 220. Each tooth 222 is rounded at its outermost edge 225 opposite the central portion 218 between the respective pair of adjacent slots. Each slot 224 or 226 is tapered moving from the side 223 of the longitudinal member 212 toward the central portion 218, where it is rounded at its end 227, which is spaced from the central portion 218. Each corner 229 of the longitudinal member 212 is also rounded. As described above, the material and dimensions of the deformable link 210 can be modified to alter the bending characteristics as needed.

Arranged as described above, the deformable link 210 will bow under overloading conditions. This bowing or bending action first serves as an indicator that the apparatus has been overloaded. As mentioned previously, the davit assembly 150 is arranged such that the support member 238 from which the load is suspended extends upwardly, defining an angle between the support member 238 and side plates 234 greater than 90 degrees. In such an arrangement, the deformable link 210 will not act to reduce the effect of overloading on the other assembly components unless it is overloaded enough to bend to an extent such that the angle between the support member 238 and the side plates 234 is reduced to 90 degrees or less. This is due to the fact that the moment exerted about the attachment point 236 is greatest when the support member 238 and side plates 234 are at right angles to each other. So preliminary bending causing the angle between the support member 238 and the plates 234 to decrease from the original angle to 90 degrees will only serve to indicate to a user that the apparatus has been overloaded, while further bending will decrease the magnitude of the moment created about the attachment point 237 by the load, thereby increasing the assembly's ability to support it.

The deformable link 210 is designed to undergo bending at loads exceeding this value such that it takes on the bow shape. This bending or bowing action serves to visually indicate to a user that the apparatus has been overloaded and prevent damage to members that would otherwise be caused by the excessive load. When the user sees the deformable link start to bend, he or she can respond to the visual feedback by removing the load to prevent further bending and possible accidents. In the case where the angle between members is 90 degrees or less before bending, the deformable link 210 also serves to reduce the effect of the load on the apparatus during exposure to overloading. When the deformable link 210 bends as shown, the angle between the members decreases, thereby moving the load closer to the post. This reduces the magnitude of the moment induced about the attachment point by the loading of the second member, increasing the effective resistance of the fastening means and thereby reducing the likelihood of further collapse of the apparatus.

Since various modifications can be made in my invention as herein above described, and many apparently widely different embodiments of same made within the spirit and scope of the Claims without department from such spirit and scope, it is intended that all matter contained in the accompanying specification shall be interpreted as illustrative only and not in a limiting sense.

The invention claimed is:

1. Apparatus comprising:

a base carried on ground wheels for movement over a ground surface to an elevated structure on which one or more persons is intended to work;

a ladder upstanding from the base to an elevated position above the base;

the upstanding ladder being adjustable in height relative to the base;

the upstanding ladder including two side rails and transverse rungs such that said one or more persons can climb the ladder to the elevated structure;

at least one of the side rails of the ladder having mounted thereon a tubular receptacle;

a post member mounted in the tubular receptacle and shaped and arranged so as to extend upwardly from the receptacle, wherein the tubular receptacle is vertical and the post member includes a vertical post portion and an arm extending from the post portion;

a deformable link between the post portion and the arm, the deformable link comprising a longitudinal member having opposite ends spaced apart by a first distance along a longitudinal axis, said deformable link comprising at least one slot transverse to the longitudinal axis, said deformable link extending between a first connection point on the post portion and a second connection point on the arm thereby supporting the atm on the post portion, the deformable link being adapted to bend if the load exceeds the load limit of the apparatus thereby visually indicating overloading of the apparatus, the arm being arranged to move during bending of the deformable link such that the distance between the ends of the deformable link is decreased; and at least one support member at an end of the arm remote from the tubular receptacle for attachment to and loading from a personal fall arrest system for attachment to said one or more persons.

2. The apparatus according to claim 1 wherein each of the side rails includes a respective tubular receptacle and a respective post member and wherein there are at least two support members one each carried on a respective one of the post members and each for receiving the personal fall arrest system of a respective one of two separate persons.

3. The apparatus according to claim 1 wherein there is provided a platform at a top of the ladder extending from the top of the ladder outwardly over the base.

4. The apparatus according to claim 1 wherein the post member and the support member are arranged such that the support member is cantilevered generally over a mid line of the base.

5. The apparatus according to claim 1 wherein each support member comprises a loop for receiving a hook of the personal fall arrest system.

6. The apparatus according to claim 1 wherein there is provided a platform between rails at the top of the ladder for the person to step onto the elevated structure.

7. The apparatus according to claim 1 wherein the tubular receptacle allows adjustment of the post member relative to the side rail of the ladder.

8. The apparatus according to claim 1 wherein the tubular receptacle allows height adjustment of the post member relative to the side rail of the ladder.

9. The apparatus according to claim 1 wherein the load is supported on the arm at a loading point distally spaced from the post.

10. The apparatus according to claim 1 wherein the deformable link further comprises a plurality of slots spaced along the deformable link between the opposite ends thereof, said slots extending into said deformable link from a first side thereof.

11. The apparatus according to claim 10 wherein the deformable link comprises a U-shaped cross section defining a central portion separating two spaced apart side portions, said side portions extending from the central portion toward the first side of the deformable link such that the plurality of slots are spaced along and extend into each of said side portions.

12. The apparatus according to claim 11 wherein the slots in the side portions of the longitudinal member do not extend to the central section thereof.

13. A fall arrest system comprising:

a movable base;

a vertical post portion coupled to the base;

an arm extending from the post portion;

a deformable link extending between a first connection point on the post portion and a second connection point on the arm such that the deformable link supports the arm on the post portion, the deformable link configured to bend if the load exceeds the load limit of the fall arrest system thereby visually indicating overloading of the apparatus; wherein the deformable link comprises a longitudinal axis and at least one slot transverse to the longitudinal axis and configured and arranged to provide desired characteristics of the deformable link; and at least one support member coupled at an end of the arm for attachment to and loading from a personal fall arrest system for attachment to said one or more persons.

14. The fall arrest system of claim 13, wherein the deformable link further comprises:

a U-shaped cross section elongated member having a central portion that separates two spaced apart side portions, each side portion including a plurality of spaced slots that are configured and arranged to provide desired characteristics of the deformable link.

* * * * *

UNITED STATES PATENT AND TRADEMARK OFFICE

CERTIFICATE OF CORRECTION

PATENT NO. : 7,828,116 B2
APPLICATION NO. : 11/509084
DATED : November 9, 2010
INVENTOR(S) : Jan Vetesnik It is certified that error appears in the above-identified patent and that said Letters Patent is hereby corrected as shown below:

Column 8, Line 61, in Claim 1: “atm” should read --arm--.

Signed and Sealed this
Twenty-eighth Day of December, 2010

David J. Kappos

David J. Kappos
*Director of the United States Patent and Trademark Office*